US008087098B2

(12) United States Patent
Kimberly et al.

(10) Patent No.: US 8,087,098 B2
(45) Date of Patent: Jan. 3, 2012

(54) MULTI-SECTIONAL WAISTBAND QUICK RELEASE UNDERGARMENT

(76) Inventors: Judy Kimberly, Columbus, OH (US); Julie Serovich, Columbus, OH (US); Jared Serovich, Columbus, OH (US); Justin Serovich, Columbus, OH (US)

( * ) Notice: Subject to any disclaimer, the term of this patent is extended or adjusted under 35 U.S.C. 154(b) by 673 days.

(21) Appl. No.: 12/242,434

(22) Filed: Sep. 30, 2008

(65) Prior Publication Data

US 2010/0077535 A1 Apr. 1, 2010

(51) Int. Cl.
*A41D 1/06* (2006.01)
*A41B 9/00* (2006.01)

(52) U.S. Cl. ..... 2/400; 2/403; 2/406; 2/228; 2/238; 2/227

(58) Field of Classification Search ..... 2/400–406, 2/408, 228, 238, 227, 69, 114, 80, 83, 78.1, 2/78.2, 78.3, 78.4, 73; 450/102, 103, 108, 450/148; 604/385–400
See application file for complete search history.

(56) References Cited

U.S. PATENT DOCUMENTS

| | | | | | |
|---|---|---|---|---|---|
| 1,512,171 | A | * | 10/1924 | Homling | 2/78.2 |
| 2,010,483 | A | * | 8/1935 | Goodman | 2/78.2 |
| 2,638,900 | A | * | 5/1953 | Gruenberg et al. | 2/408 |
| 3,145,394 | A | * | 8/1964 | Melton | 2/403 |
| 4,145,763 | A | * | 3/1979 | Abrams et al. | 2/403 |
| 4,258,440 | A | | 3/1981 | McGowan | |
| 4,446,575 | A | * | 5/1984 | Davis | 2/400 |
| 4,637,078 | A | * | 1/1987 | Southwell | 2/408 |
| 4,675,918 | A | * | 6/1987 | O'Brien | 2/402 |
| 4,835,795 | A | * | 6/1989 | Lonon | 2/408 |
| 4,930,161 | A | * | 6/1990 | Cohen | 2/114 |
| 4,951,321 | A | | 8/1990 | Mortensen et al. | |
| 5,315,716 | A | | 5/1994 | Baum | |
| 5,546,608 | A | * | 8/1996 | Russano | 2/408 |
| 5,603,123 | A | | 2/1997 | Chupa | |
| 5,802,611 | A | | 9/1998 | McKenzie et al. | |
| 5,871,132 | A | | 2/1999 | Hargreaves | |
| 6,397,393 | B2 | | 6/2002 | Alger | |
| 6,560,786 | B2 | | 5/2003 | Lipton | |
| 2007/0028343 | A1 | | 2/2007 | Makowka | |
| 2007/0199128 | A1 | | 8/2007 | Golle | |

* cited by examiner

*Primary Examiner* — Gloria Hale
(74) *Attorney, Agent, or Firm* — Michael J Gallagher; David J Dawsey; Gallagher & Dawsey Co., LPA

(57) ABSTRACT

A multi-sectional waistband quick release undergarment is provided. The multi-sectional waistband quick release undergarment includes a multi-sectional waistband having a first waistband section and a second waistband section for securing the undergarment to a wearer's body. An undergarment body includes a front panel and a rear panel, which are joined to the first waistband section and the second waistband section, respectively. At least a portion of the first waistband section is releasably secured to at least a portion of the second waistband section, and at least a portion of the front panel is releasably secured to at least a portion of the rear panel. When a predetermined breakaway force is exerted on the second waistband section, the second waistband section releases from the first waistband section and the rear panel releases from the front panel; and thereby provides effective protection against wedgies.

11 Claims, 4 Drawing Sheets

MULTI-SECTIONAL WAISTBAND QUICK RELEASE UNDERGARMENT

TECHNICAL FIELD

The instant invention relates to apparel, and more particularly, to a multi-sectional waistband quick release undergarment.

BACKGROUND OF THE INVENTION

For many decades, if not centuries, bullies and pranksters have manifested dominance over their physically weaker victims through various methods of physical abuse. One such method often employed by bullies and pranksters has become commonly known as "the wedgie."

As its name suggests, a wedgie occurs when one's clothing, typically pants or undergarments, is wedged between the buttocks. In giving a wedgie, a bully or prankster usually grabs the rear of the victim's undergarment or pants and forcefully yanks upwards. Often times the result is quite painful. In fact, in recent U.S. news, a teenage boy had to be taken to the emergency room as a result of a wedgie so violent that his undergarment was ripped in half.

Over the years, the common wedgie has evolved into several variations. One variation is the atomic wedgie. An atomic wedgie occurs when the waistband of the undergarment is pulled up and over the victim's head. Another variation is the hanging wedgie. In the hanging wedgie, the bully or prankster will attach the victim's undergarment on a hook or other object such that the victim is elevated above the ground. Still another variation is the Melvin. The Melvin is similar to the common wedgie except it is executed by yanking up the front waistband of the victim's undergarment.

There remains a need for an undergarment that provides effective protection against the bully or prankster induced wedgie. The present invention addresses this need by providing a multi-sectional waistband quick release undergarment.

SUMMARY OF INVENTION

In its most general configuration, the present invention advances the state of the art with a variety of new capabilities and overcomes many of the shortcomings of prior devices in new and novel ways. The present invention overcomes the shortcomings and limitations of the prior art in any of a number of generally effective configurations. The instant invention demonstrates such capabilities and overcomes many of the shortcomings of prior methods in new and novel ways.

The present invention relates to a multi-sectional waistband quick release undergarment. The multi-sectional waistband quick release undergarment is configured to provide effective protection against wedgies.

Generally, the multi-sectional waistband quick release undergarment includes a multi-sectional waistband and an undergarment body. The multi-sectional waistband secures the multi-sectional waistband quick release undergarment to a wearer's body and includes a first waistband section, a second waistband section, and a waistband circumference. The undergarment body has a front panel, a rear panel, and an exterior body surface area. The front panel is joined to the first waistband section and is defined by a front body portion, a dextral body portion, a sinistral body portion, and a crotch portion. The dextral body portion and the crotch portion define a dextral leg opening, while the sinistral body portion and the crotch portion define a sinistral leg opening. The rear panel is joined to the second waistband section and is defined by a rear body portion having a rear dextral edge, a rear sinistral edge, and a rear bottom edge.

In one embodiment, the first waistband section is releasably secured to the second waistband section and the front panel is releasably secured to the rear panel. When the first waistband section is secured to the second waistband section and the front panel is secured to the rear panel, the multi-sectional waistband quick release undergarment may be donned by a wearer.

In operation, when a predetermined breakaway force is exerted on the second waistband section, the second waistband section is released from the first waistband section and the rear panel is released from the front panel. Thus, when a wedgie is attempted, the rear panel separates from the front panel, and the discomfort that is typically associated with a wedgie is avoided.

In one particular embodiment, the multi-sectional waistband quick release undergarment further includes a breakaway panel connection system. The breakaway panel connection system includes at least one front panel connection member and at least one rear panel connection member to releasably secure the second waistband section to the first waistband section and releasably secure the rear panel to the front panel. The front and rear panel connection members may comprise various types of releasable fastening devices.

Furthermore, the multi-sectional waistband quick release undergarment may be designed and configured with various performance enhancing features. For example, the multi-sectional waistband quick release undergarment may feature a design that lessens the amount of force to release the rear panel, or that increases the amount of force required to cause unintentional separation of the rear panel.

BRIEF DESCRIPTION OF THE DRAWINGS

Without limiting the scope of the present invention as claimed below and referring now to the drawings and figures:

DETAILED DESCRIPTION OF THE INVENTION

The multi-section waistband quick release undergarment (50) of the instant invention enables a significant advance in the state of the art. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized.

The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

With reference generally to FIGS. 1 through 5, the present invention is a multi-sectional waistband quick release undergarment (50). The multi-sectional waistband quick release undergarment (50) includes, among other elements, a multi-sectional waistband (100) and an undergarment body (200).

Figure 1:
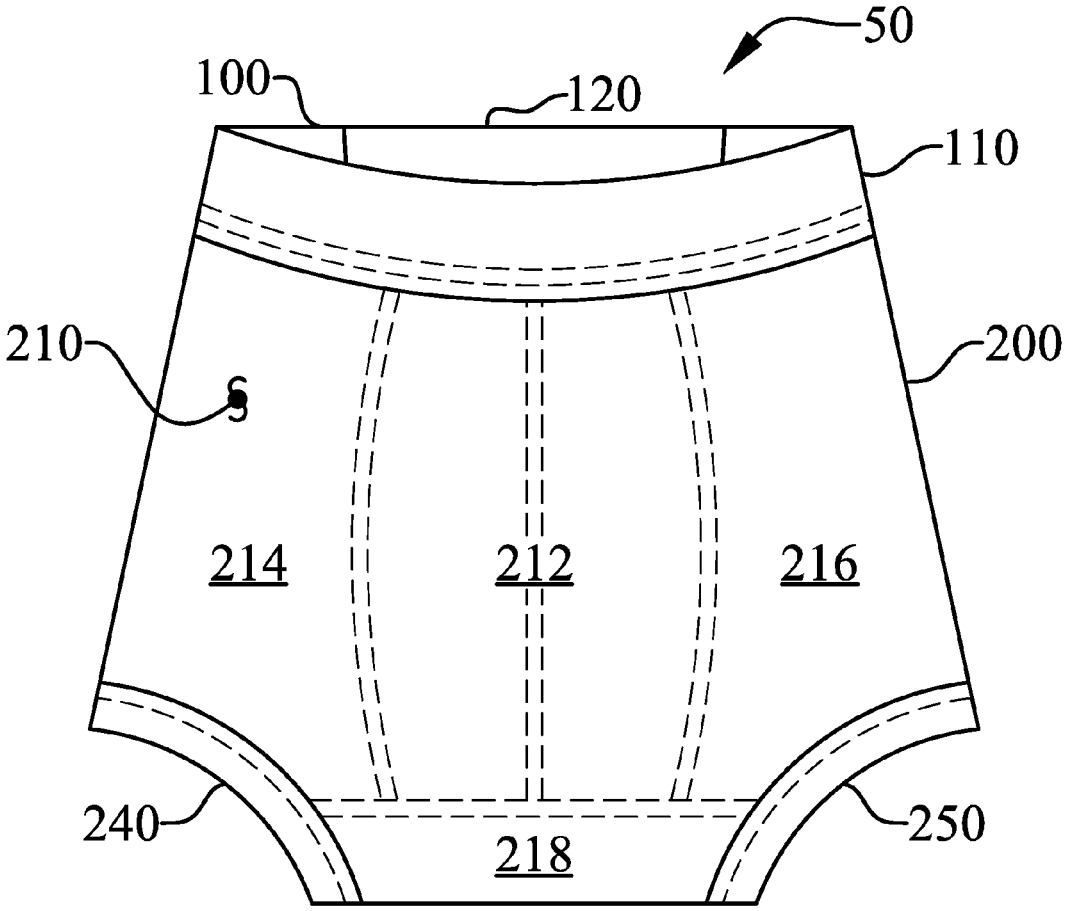
FIG. 1 is a front elevation view of an embodiment of the multi-sectional waistband quick release undergarment of the present invention, not to scale.
Figure 2:
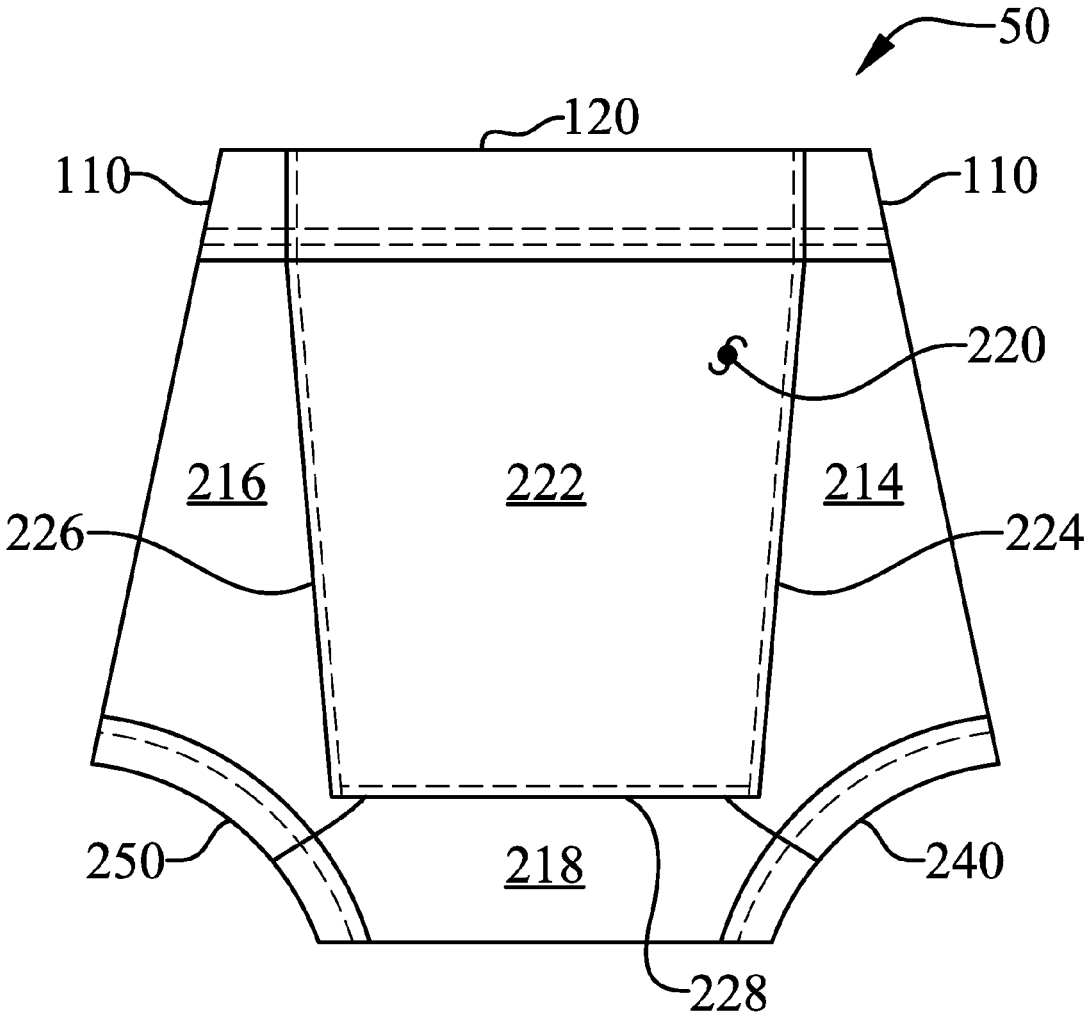
FIG. 2 is a rear elevation view of an embodiment of the multi-sectional waistband quick release undergarment of the present invention, not to scale.

Referring now to FIGS. 1 and 2, the multi-sectional waistband (100) secures the multi-sectional waistband quick release undergarment (50) to a wearer's body and includes a first waistband section (110), a second waistband section (120), and a waistband circumference. In one particular embodiment, the multi-sectional waistband (100) comprises an elastic material. However, one with skill in the art will appreciate that the multi-sectional waistband (100) may be formed of virtually any material used in the apparel arts so long as the multi-sectional waistband (100) is capable of securing the multi-sectional waistband quick release undergarment (50) to a wearer's body.

Still referring to FIGS. 1 and 2, the undergarment body (200) has a front panel (210), a rear panel (220), and an exterior body surface area. The front panel (210) is joined to the first waistband section (110) and is defined by a front body portion (212), a dextral body portion (214), a sinistral body portion (216), and a crotch portion (218). The dextral body portion (214) and the crotch portion (218) define a dextral leg opening (240), while the sinistral body portion (216) and the crotch portion (218) define a sinistral leg opening (250). The front panel (210) may be formed as a single piece of material, or alternatively, the front panel (210) may be formed by joining individual pieces of material that correspond to the front body portion (212), the dextral body portion (214), the sinistral body portion (216), and the crotch portion (218). Preferably, the front panel (210) is joined to the first waistband section (110) by sewing. However, one with skill in the art will appreciate that other joining methods including, but not limited to, permanent fabric adhesive and fusible web may be successfully utilized.

As seen in FIG. 2, the rear panel (220) is joined to the second waistband section (120) and is defined by a rear body portion (222) having a rear dextral edge (224), a rear sinistral edge (226), and a rear bottom edge (228). The figures illustrate the rear dextral edge (224), the rear sinistral edge (226), and the rear bottom edge (228) as being linear; however, it contemplated that the edges (224, 226, 228) may be curvilinear, jagged, linear, or combinations thereof. For example, the rear dextral edge (224) and the rear sinistral edge (226) may be linear, and the rear bottom edge (228) may be curvilinear. The rear panel (220) is preferably joined to the second waistband section (120) by sewing, although one with skill in the art will recognize that other joining methods may be utilized, such as permanent fabric adhesive and fusible web, just to name a couple.

The undergarment body (200) may be formed of one or more materials. For example, both the front panel (210) and the rear panel (220) may be constructed of cotton fabric. Alternatively, the front panel (210) may comprise a moisture wicking fabric and the rear panel (220) may comprise a cotton-polyester blend fabric. In fact, the undergarment body (200) may comprise any material or combination of materials that are used in the apparel arts.

For example, in one embodiment, the undergarment body (200) may be engineered so that the rear panel (220) is constructed of a stronger more tear resistant material than the front panel (210), or vice versa. Such an embodiment would help save material costs and provide an increase durability by using a more expensive, stronger material to construct only a portion of the undergarment (50), as opposed to the entire undergarment (50).

Still referring to FIG. 2, the first waistband section (110) is releasably secured to the second waistband section (120) and the front panel (210) is releasably secured to the rear panel (220). As seen in FIG. 2, a portion of the second waistband section (120) overlaps a portion of the first waistband section (110) and a portion of the rear panel (220) overlaps a portion of the front panel (210). However, one with skill in the art will appreciate that the opposite configuration may be utilized as well, namely, a portion of the first waistband section (110) may overlap a portion of the second waistband section (120) and a portion of the front panel (210) may overlap a portion of the rear panel (220). With the first waistband section (110) releasably secured to the second waistband section (120) and the front panel (210) releasably secured to the rear panel (220), a wearer may now don the multi-sectional waistband quick release undergarment (50) as they would any other undergarment.

Although the multi-sectional waistband quick release undergarment (50) is shown throughout the figures as a brief style undergarment, other undergarment styles are contemplated. By way of example, and not limitation, the multi-sectional waistband quick release undergarment (50) may be briefs, boxer shorts, bikini briefs, boy shorts, or boxer briefs.

Figure 3:
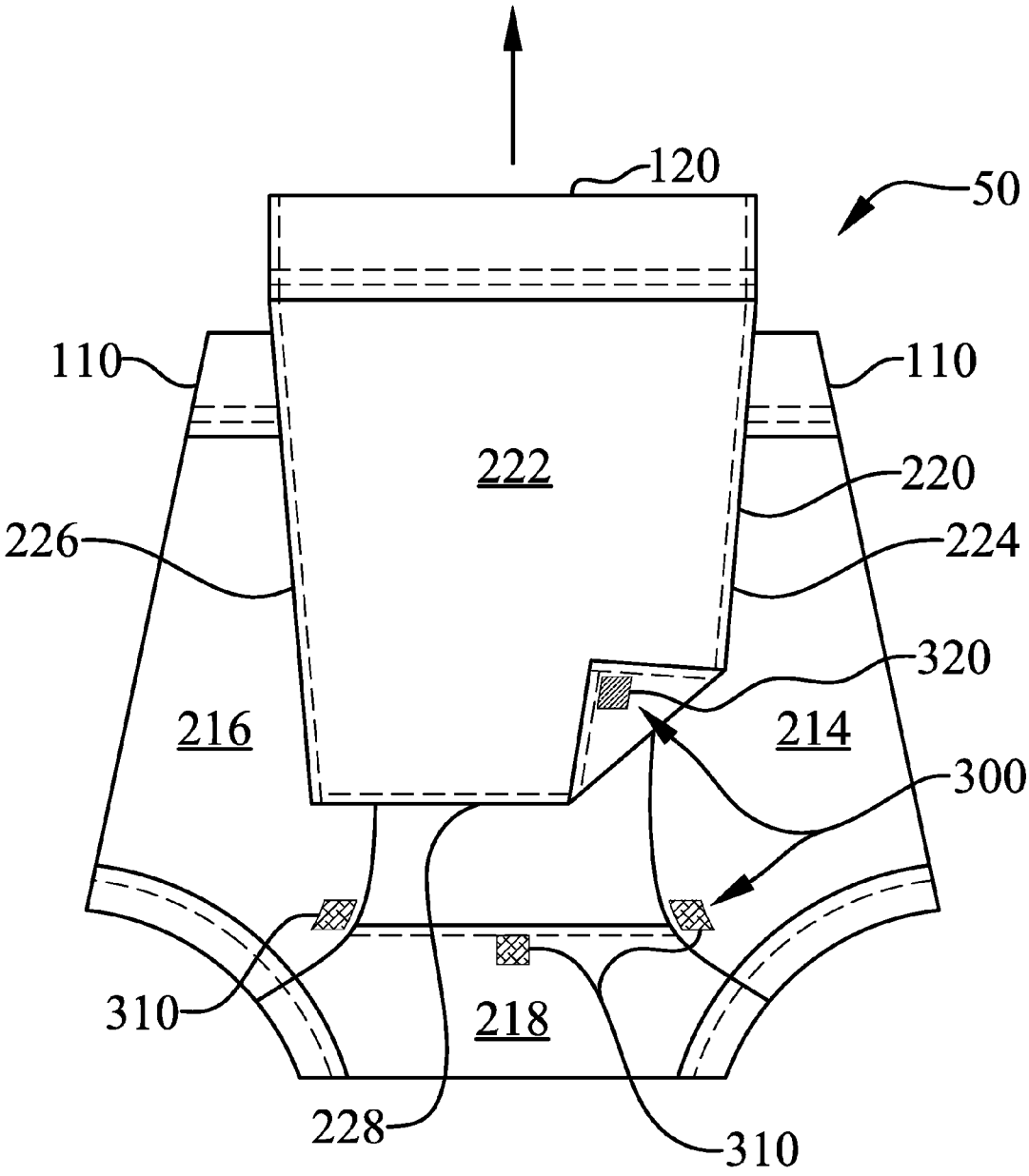
FIG. 3 is a rear elevation view of an embodiment of the multi-sectional waistband quick release undergarment of the present invention, not to scale.

The operation of the multi-sectional waistband quick release undergarment (50) is illustrated in FIG. 3. As seen in FIG. 3, when a predetermined breakaway force is exerted on the second waistband section (120), the second waistband section (120) is released from the first waistband section (110) and the rear panel (220) is released from the front panel (210). The predetermined breakaway force may be defined as the minimum force required to completely separate the second waistband section (120) from the first waistband section (110) and the rear panel (220) from the front panel (210). In one embodiment, the predetermined breakaway force is 40 pounds-force or less. This will provide most children and young adolescents with the ability to exert the required predetermined breakaway force.

Figure 5:
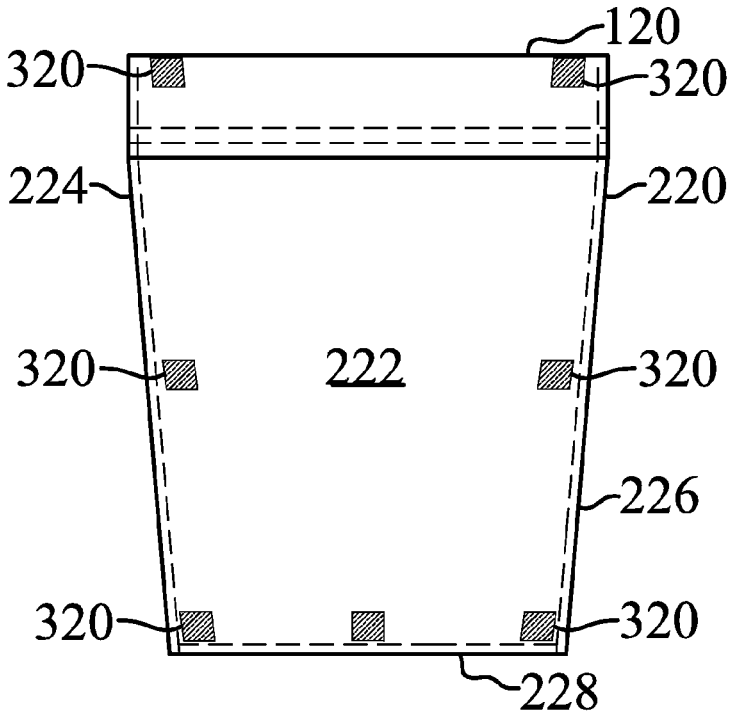
FIG. 5 is a front elevation view of a rear panel of the multi-sectional waistband quick release undergarment of the present invention, not to scale.

Referring now to FIGS. 2, 3 and 5, the rear panel (220) is illustrated as having a substantially trapezoidal shape. By utilizing a substantially trapezoidal shape, the rear dextral edge (224) and the rear sinistral edge (226) converge towards the rear bottom edge (228), which concentrates the force exerted on the second waistband section (120), making the rear panel (220) easier to remove. However, other geometries for the rear panel (220) may be successfully employed. For example, the rear panel (220) may be shaped as a rectangle, a square, D-shaped, or a triangle, just to name a few. Additionally, the front panel (210) would be designed accordingly to accommodate the particular geometry chosen for the rear panel (220) such that the wearer is adequately covered.

Figure 4:
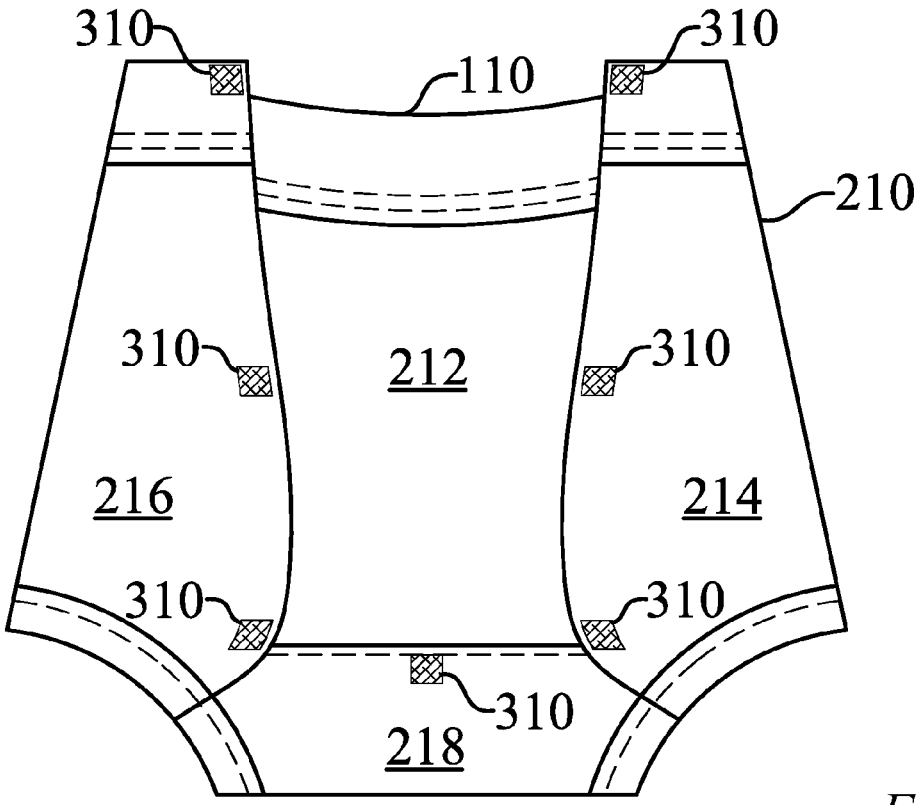
FIG. 4 is a rear elevation view of a front panel of the multi-sectional waistband quick release undergarment of the present invention, not to scale.

With reference now to FIGS. 3, 4 and 5, in one particular embodiment, the multi-sectional waistband quick release undergarment (50) further comprises a breakaway panel connection system (300). The breakaway panel connection system (300) includes at least one front panel connection member (310) secured to at least a portion of the first waistband section (110), at least a portion of the dextral body portion (214), at least a portion of the sinistral body portion (216), and at least a portion of the crotch portion (218). Likewise, the breakaway panel connection system (300) includes at least one rear panel connection member (320) secured to at least a portion of the second waistband section (120), at least a portion adjacent the rear dextral edge (224), at least a portion adjacent the rear sinistral edge (226), and at least a portion adjacent the rear bottom edge (228).

The respective front panel connection members (310) and rear panel connection members (320) are positioned on the first waistband section (110), the second waistband section (120), the front panel (210), and the rear panel (220) such that the front panel connection members (310) and the rear panel connection members (320) are aligned for releasably attaching to one another. Thus, as seen in FIGS. 4 and 5, the at least one front panel connection member (310) secured to at least a portion of the first waistband section (110) may be releasably attached to the at least one rear panel connection member (320) secured to at least a portion of the second waistband section (120). Similarly, the at least one front panel connection member (310) secured to at least a portion of the dextral body portion (214) may be releasably attached to the at least one rear panel connection member (320) secured to at least a portion adjacent the rear dextral edge (224). In the same way, the at least one front panel connection member (310) secured to at least a portion of the sinistral body portion (216) may be releasably attached to the at least one rear panel connection member (320) secured to at least a portion adjacent the rear sinistral edge (226). Likewise, the at least one front panel connection member (310) secured to at least a portion of the crotch portion (218) may be releasably attached to the at least one rear panel connection member (320) secured to at least a portion adjacent the rear bottom edge (228).

As illustrated in FIGS. 4 and 5, the front panel connection members (310) and the rear panel connection members (320) are depicted as small segments of hook and loop type fasteners. However, one with skill in the art will recognize that virtually any type of releasable fastening device may be used, including, but not limited to, snap fasteners, releasable clips, magnets, a key and keyway, or adhesive strips. Additionally, although FIGS. 4 and 5 show the front panel connection members (310) and the rear panel connection members (320) as relatively small segments of material, the connection members (310, 320) may be a longer, continuous segment of material. For example, the rear panel connection member (320) secured to a portion of the rear panel (220) adjacent the rear dextral edge (224) may extend along a majority of a portion adjacent the rear dextral edge (224). Likewise, the front panel connection member (310) secured to a portion of the dextral body portion (214) would be designed and positioned to enable releasable attachment to the corresponding rear panel connection member (320).

The front panel connection members (310) and the rear panel connection members (320) may be secured to the first waistband section (110), the second waistband section (120), the front panel (210), and the rear panel (220) by various methods. By way of example, and not limitation, the connection members (310, 320) may be secured by sewing, adhesives, plying (for securing the snap fasteners), heat activated fusing, or combinations thereof.

When the rear panel (220) is removed from the multi-sectional waistband quick release undergarment (50) by an attempted wedgie, it is preferable that the front panel (210) maintain a position corresponding as close as possible to the position of the front panel (210) when still attached to the rear panel (220). Thus, in one embodiment, the rear panel (220) comprises no more than 15 percent of the exterior body surface area. Having the front panel (210) comprise most of the exterior body surface area allows the front panel (210) to resist shifting position after the rear panel (220) has been removed.

Along similar lines, a bully or prankster typically performs a wedgie by pulling a victim's waistband upwards at a point near the victim's gluteal cleft. As such, in another embodiment, the second waistband section (120) comprises no more than 20 percent of the waistband circumference. By reducing the second waistband section (120) to 20 percent or less of the waistband circumference, the first waistband section (110) is allowed to extend further around the wearer and thereby help resist shifting when the second waistband section (120) and rear panel (220) are forcefully removed. Additionally, the smaller second waistband section (120) provides increased comfort and the feel of normal undergarments. Such an embodiment also saves material costs and eases manufacturing.

In another embodiment, the first waistband section (110) comprises an elastic material and the second waistband section (120) comprises a non-elastic material. Using a non-elastic material for the second waistband section (120) provides a more rigid grasping point for executing a wedgie. Thus, the chance that the second waistband section (120) is separated from the rear panel (220) during a wedgie is substantially lessened.

In yet another embodiment, the dextral leg opening (240) and the sinistral leg opening (250) may include elastic material. Providing the dextral leg opening (240) and the sinistral leg opening (250) with an elastic material will further enable the front panel (210) to remain attached to the wearer and resist shifting position after the rear panel (220) is removed.

While the figures illustrate a front panel connection member (310) secured to a portion of the crotch portion (218) and a rear panel connection member (320) secured to a portion adjacent the rear bottom edge (228) such a connection is not required. In fact, in one embodiment, the crotch portion (218) does not releasably attach to the rear bottom edge (228). In this particular configuration, the front panel (210) and the rear panel (220) are releasably attached and adequately cover the wearer, but the predetermined breakaway force is reduced, making it easier to remove the rear panel (220) when a wedgie is attempted.

In yet another embodiment, the front panel connection members (310) and the rear panel connection members (320) may be engineered such that the orientation of the front panel and rear panel connection members (310, 320) enhance the performance of the multi-sectional waistband quick release undergarment (50). The front panel connection members (310) and the rear panel connection members (320) may be configured such that the predetermined breakaway force is reduced in the vertical direction, while at the same time increasing the amount of force in other directions to minimize the chance of unintentional separation. By way of example only, and not limitation, if the front panel connection members (310) comprise a vertically aligned keyway, and the rear panel connection members (320) comprises a vertically aligned key, then the rear panel (220) will be easily removable by pulling the second waistband section (120) upwards. At the same time, the rear panel (220) will resist separation if a force is exerted in another direction.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A multi-sectional waistband quick release undergarment comprising:

a) a multi-sectional waistband for securing the multi-sectional waistband quick release undergarment to a wearer's body, the multi-sectional waistband having a first waistband section, a second waistband section, and a waistband circumference; and b) an undergarment body having a front panel, a rear panel, and an exterior body surface area, wherein:

i) the front panel is joined to the first waistband section, the front panel defined by a front body portion, a dextral body portion covering at least a portion of an anterior body surface and at least a portion of a posterior body surface, a sinistral body portion covering at least a portion of an anterior body surface and at least a portion of a posterior body surface, and a crotch portion, wherein the dextral body portion is fixedly attached to the crotch portion to define a dextral leg opening circumferentially surrounding the wearer's right leg in a wearing position, and the sinistral body portion is fixedly attached to the crotch portion to define a sinistral leg opening circumferentially surrounding the wearer's left leg in a wearing position; and ii) the rear panel is joined to the second waistband section, the rear panel defined by a rear body portion having a rear dextral edge, a rear sinistral edge, and a rear bottom edge; and c) wherein the first waistband section is releasably secured to the second waistband section and the front panel is releasably secured to the rear panel, such that when a predetermined breakaway force is exerted on the second waistband section, the second waistband section is released from the first waistband section and the rear panel is released from the front panel; and d) after said release, the front portion and the crotch portion remain partially covering the wearer's body.

2. The multi-sectional waistband quick release undergarment of claim 1, further comprising a breakaway panel connection system, wherein the breakaway panel connection system comprises:

a) at least one front panel connection member secured to at least a portion of the first waistband section, at least a portion of the dextral body portion, at least a portion of the sinistral body portion, and at least a portion of the crotch portion; and b) at least one rear panel connection member secured to at least a portion of the second waistband section, at least a portion adjacent the rear dextral edge, at least a portion adjacent the rear sinistral edge, and at least a portion adjacent the rear bottom edge; and wherein:

i) the at least one front panel connection member secured to at least a portion of the first waistband section releasably attaches to the at least one rear panel connection member secured to at least a portion of the second waistband section; and ii) the at least one front panel connection member secured to at least a portion of the dextral body portion releasably attaches to the at least one rear panel connection member secured to at least a portion adjacent the rear dextral edge; and iii) the at least one front panel connection member secured to at least a portion of the sinistral body portion releasably attaches to the at least one rear panel connection member secured to at least a portion adjacent the rear sinistral edge; and iv) the at least one front panel connection member secured to at least a portion of the crotch portion releasably attaches to the at least one rear panel connection member secured to at least a portion adjacent the rear bottom edge.

3. The multi-sectional waistband quick release undergarment of claim 1, wherein the second waistband section comprises no more than 20 percent of the waistband circumference.

4. The multi-sectional waistband quick release undergarment of claim 1, wherein the rear panel comprises no more than 15 percent of the exterior body surface area.

5. The multi-sectional waistband quick release undergarment of claim 1, wherein a portion of the second waistband section overlaps a portion of the first waistband section and a portion of the rear panel overlaps a portion of the front panel.

6. The multi-sectional waistband quick release undergarment of claim 1, wherein a style of the multi-sectional waistband quick release undergarment is selected from the group consisting of briefs, boxer shorts, and boxer briefs.

7. The multi-sectional waistband quick release undergarment of claim 1, wherein the multi-sectional waistband comprises an elastic material.

8. The multi-sectional waistband quick release undergarment of claim 1, wherein the first waistband section comprises an elastic material and the second waistband section comprises a non-elastic material.

9. The multi-sectional waistband quick release undergarment of claim 1, wherein the predetermined breakaway force is 40 pounds-force.

10. The multi-sectional waistband quick release undergarment of claim 1, wherein the rear panel has a substantially trapezoidal shape.

11. A multi-sectional waistband quick release undergarment comprising:

a) a multi-sectional waistband for securing the multi-sectional quick release undergarment to a wearer's body, the multi-sectional waistband having a first waistband section and a second waistband section; and b) an undergarment body having at least a front panel and at least a rear panel, wherein the front panel is joined to the first waistband section and the rear panel is joined to the second waistband section; and c) wherein at least a portion of the first waistband section is releasably secured to at least a portion of the second waistband section, and at least a portion of the front panel is fixedly secured to a crotch portion and at least a portion of the front panel is releasably secured to at least a portion of the rear panel, such that when a predetermined breakaway force is exerted on the second waistband section, the second waistband section releases from the first waistband section and the rear panel releases from the front panel.

* * * * *